US005679158A

United States Patent [19]

Holzer, Jr. et al.

[11] Patent Number: 5,679,158

[45] Date of Patent: Oct. 21, 1997

[54] FINISH NOZZLE AND APPLICATION ASSEMBLY FOR A SYNTHETIC FILAMENT SPINNING APPARATUS

[75] Inventors: Carl R. Holzer, Jr., Anderson, S.C.; Walter L. Shaw, Canon, Ga.; Bobby L. Tinsley; Gary Hanwell, both of Anderson, S.C.

[73] Assignee: BASF Corporation, Mount Olive, N.J.

[21] Appl. No.: 616,478

[22] Filed: Mar. 19, 1996

[51] Int. Cl.[6] ..... B05C 3/02; B05C 3/12; B05C 19/02; B05B 13/02

[52] U.S. Cl. ..... 118/407; 68/200; 8/151.2; 425/114; 118/419; 118/DIG. 18; 118/DIG. 19; 118/420; 427/434.6

[58] Field of Search ..... 118/405, 420, 118/428, 313, 315, 325, 407, 419, DIG. 18, DIG. 19, DIG. 22; 425/114; 239/565, 288, 288.3, 288.5; 68/200; 8/151.2; 427/434.6, 389.9

[56] References Cited

U.S. PATENT DOCUMENTS

| | | | |
|---|---|---|---|
| 1,934,796 | 11/1933 | Friederich | 118/DIG. 19 |
| 3,831,875 | 8/1974 | Jacobsson . | |
| 4,059,240 | 11/1977 | Laursen . | |
| 4,066,558 | 1/1978 | Shay et al. . | |
| 4,074,857 | 2/1978 | Calder | 239/119 |
| 4,253,416 | 3/1981 | Williams, Jr. | 118/420 |
| 4,255,473 | 3/1981 | Williams, Jr. | 118/420 |
| 4,268,550 | 5/1981 | Williams, Jr. | 427/434.6 |
| 4,301,101 | 11/1981 | Bachmann et al. . | |
| 4,329,750 | 5/1982 | Binnersley | 8/151.2 |
| 4,388,057 | 6/1983 | Bachmann et al. . | |
| 4,397,164 | 8/1983 | Binnersley | 68/200 |
| 4,417,383 | 11/1983 | Anderson et al. . | |
| 4,469,248 | 9/1984 | Petrecca | 222/48 |
| 4,484,707 | 11/1984 | Calder | 239/119 |
| 4,553,709 | 11/1985 | Bock et al. . | |
| 4,565,154 | 1/1986 | Mullins et al. | 118/410 |
| 4,595,600 | 6/1986 | Keeven et al. | 427/5 |
| 4,717,604 | 1/1988 | Justus | 427/434.7 |
| 4,759,960 | 7/1988 | Zaman | 427/356 |
| 4,891,960 | 1/1990 | Shah | 68/200 |
| 4,959,951 | 10/1990 | Mori . | |
| 5,173,119 | 12/1992 | Watanabe et al. | 118/410 |
| 5,501,734 | 3/1996 | Oliphant | 118/234 |

*Primary Examiner*—Donald E. Czaja
*Assistant Examiner*—Jacqueline A. Ruller
*Attorney, Agent, or Firm*—Nixon & Vanderhye P.C.

[57] ABSTRACT

A finish applicator mounting unit includes an apertured member having a plurality of apertures shaped to receive a corresponding plurality of finish applicator nozzles, and a locking mechanism that selectively obstructs the plurality of apertures such that when the corresponding plurality of finish applicator nozzles are received in the plurality of apertures, the finish applicator nozzles are selectively locked in the finish applicator mounting unit. The mounting unit preferably includes an alignment pin that ensures both proper alignment and proper insertion of the finish applicator nozzles. The finish applicator nozzles include a ceramic applicator head fictionally received in an elastic connector. A filament slot is configured to cooperate with the alignment pin to ensure the proper alignment and insertion of the nozzles. The nozzles operate more effectively and efficiently than conventional nozzles, and the mounting unit enables easy access to the nozzles for cleaning, repair and/or replacement.

27 Claims, 7 Drawing Sheets

FINISH NOZZLE AND APPLICATION ASSEMBLY FOR A SYNTHETIC FILAMENT SPINNING APPARATUS

FIELD OF THE INVENTION

The present invention relates generally to the field of synthetic filament production. In preferred forms, the present invention is embodied in a finish nozzle and applicator assembly for applying a liquid finish material to the filaments.

BACKGROUND AND SUMMARY OF THE INVENTION

Synthetic filaments are traditionally produced by various spinning techniques. For example, synthetic filaments may be melt-spun by extruding a melt spinnable polymer through relatively small-sized orifices in a spin pack to form a stream of filaments that are substantially immediately solidified in a quench cabinet. The filaments are thereafter continuously taken up by a high speed winder to form a generally cylindrical package. Depending on the intended end use, the filaments may be flat (undrawn) or may be subjected to a drawing step prior to being taken up to form the package.

The solidified filaments are typically passed through a metered finish applicator, which applies a liquid finish material (colloquially referred to as a "finish oil") so as to lubricate the filaments to reduce filamentary friction and/or to achieve desired processability characteristics. Typically, a finish applicator mounting unit supports a plurality of finish applicator nozzles that each include a slot to receive the individual filament threadlines. A portion of the slot against which the filaments are guided includes a small opening for the finish oil. A pump supplies the finish oil at a pressure slightly above atmospheric. Thus, as the filaments pass through the finish applicator, the finish oil is coated onto the filaments.

A conventional finish applicator nozzle includes a ceramic applicator head that is bonded (e.g. via adhesive) to a stainless steel holder. An O-ring provides a seal between the finish applicator nozzle and the finish applicator mounting unit. Problems arise with the conventional finish applicator nozzles in that the bonded connection between the ceramic applicator head and the stainless steel holder often leaks. In addition, the O-rings providing the seal between the nozzle and the mounting unit deteriorate over time.

It would therefore be desirable if an improved finish applicator assembly was provided that overcomes the problems of the conventional arrangement. It is toward providing such an improved finish applicator assembly and its associated nozzles that the present invention is directed.

In this regard, a finish applicator nozzle according to the invention includes elements that are frictionally secured to one another, thereby avoiding the necessity of providing a bonded connection. In addition, the finish applicator nozzle of the invention is provided with a specifically configured filament slot that ensures proper insertion of the nozzle in its mounting unit.

In particular, the finish applicator nozzle of this invention includes a ceramic applicator head having the filament slot at its forward end and a reduced perimeter connector section at its rearward end. An elastic connector has a connector opening defined at its forward end that is shaped to frictionally receive the reduced perimeter connector section. A supply line opening shaped to frictionally receive a finish supply line is defined in the elastic connector's rearward end.

The elastic connector may be formed of virtually any plastics material that is compatible with the finish oil, for example, nylon, ultra high molecular weight (UHMW) polyethylene or the like. The elastic connector preferably frictionally receives the reduced perimeter connector section providing a low pressure, liquid tight seal.

To ensure proper insertion of the nozzle, the filament slot includes a V-shaped finish oil transfer surface comprised of upper and lower transfer surfaces, respectively, which diverge rearwardly from a smooth apex surface. The discharge end of a finish oil orifice is located above the apex surface. Thus, finish oil supplied through the orifice will flow by gravity along the upper transfer surface to the apex surface where at least a portion is transferred to the threadline in contact with the apex surface. The effective length of the upper transfer surface is preferably greater than the effective length of the lower transfer surface so that the filament slot is "deeper" at the upper transfer surface as compared to the lower transfer surface. Thus, although each of the surfaces terminates at the apex surface, the apex surface is itself offset below the axial center line of the applicator head so as to achieve the differences in effective length of the surfaces. This difference in effect lengths of the transfer surfaces of the slot is therefore employed with an alignment structure associated with the nozzle assembly to ensure that the nozzle is correctly oriented (i.e., to prevent inadvertent reversal of the upper and lower transfer surfaces, which would inhibit the intended flow of finish oil to the filaments).

The finish applicator nozzles are most preferably provided in an applicator assembly. Specifically, the applicator assembly of this invention includes a finish applicator mounting unit that includes an apertured member having a plurality of apertures shaped to receive a corresponding plurality of finish applicator nozzles and a frame. The alignment structure preferably comprises an alignment pin extending into each of the plurality of apertures. The alignment pins cooperate with the filament slots of the finish applicator nozzles to ensure both proper alignment and proper insertion of the nozzles. That is, if a nozzle is inserted upside-down, the "shallower" lower transfer surface in the filament slot described above will come into contact with the alignment pin thereby preventing the nozzle from being fully inserted into its aperture.

The frame includes a guide tab plate and a locking bar. The guide tab plate is provided with a plurality of guide tabs forming a plurality of guide grooves corresponding to the plurality of apertures. The guide grooves serve to guide the threadlines to their respective nozzles. The guide tabs are preferably disposed at a downward angle from front to rear to urge excess finish oil toward a drain slot that is provided adjacent the guide tabs.

The locking bar selectively obstructs the apertures such that when the finish applicator nozzles are received in their respective apertures, the nozzles can be positively locked in the finish applicator mounting unit. The apertured member is pivotally supported by the frame such that the apertured member is pivotable between an insertion position, where the nozzles can be inserted into their respective apertures, and an operating position, where the nozzles are locked in their respective apertures. The locking bar is secured to the frame so as to obstruct the apertures in the apertured member when it is in its operating position. When the apertured member is pivoted to its insertion position, however, the plurality of apertures will be unobstructed by the locking bar. An alternative locking mechanism includes a movable bar secured to the frame for movement in a track between an operating position, in which the movable bar obstructs the plurality of apertures, and an insertion position, in which the plurality of apertures are unobstructed by the movable bar.

These and other aspects of the invention will become more clear after careful consideration is given to the following detailed description of the preferred exemplary embodiments.

BRIEF DESCRIPTION OF THE DRAWINGS

The accompanying drawings illustrate preferred exemplary embodiments of this invention wherein like reference numerals denote like structural elements, and wherein.

DETAILED DESCRIPTION OF PREFERRED EMBODIMENTS

Figure 1:
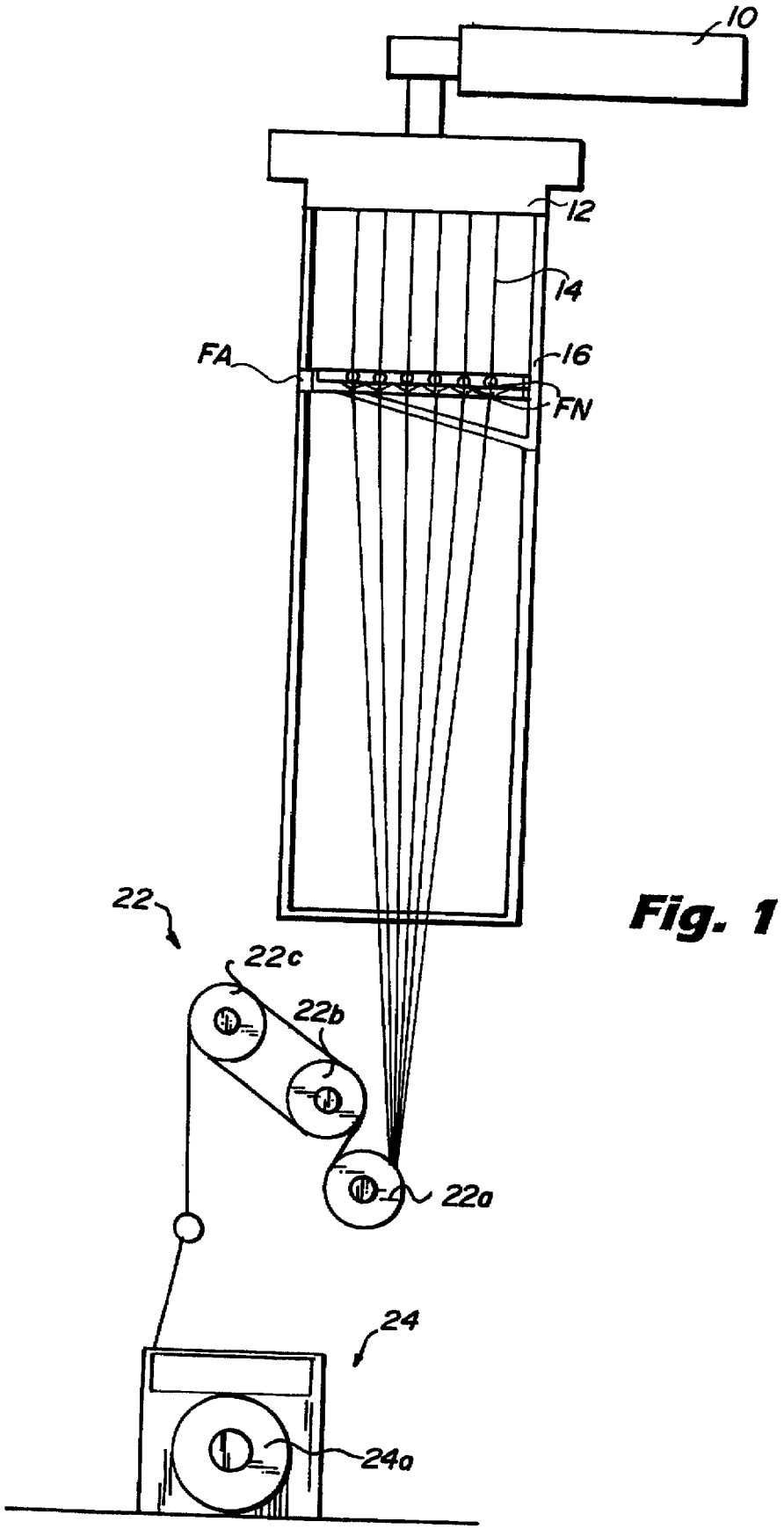
FIG. 1 is a schematic illustration of a melt spinning apparatus in which the present invention may be employed.

In a typical melt spinning apparatus as shown in FIG. 1, an extruder 10 extrudes a polymer melt through a spin pack 12 having a plurality of spinneret orifices that form a plurality of filament threadlines 14. It will be understood that, depending on the intended end use, each of the threadlines may include a single filament or may include any number of filaments forming a yarn. The filament threadlines 14 are first cooled in a quench cabinet 16 and may thereafter be drawn by a drawing assembly 22, comprised of godet rolls **22*a*–22*c*. The final product is then wound by a high speed winder 24 to form a package 24*a*. Prior to being taken up by the winder 24, the filament threadlines 14** may be brought into contact with a finish applicator FA including a plurality of finish applicator nozzles FN according to this invention so that finish oil may be applied.

Figure 2:
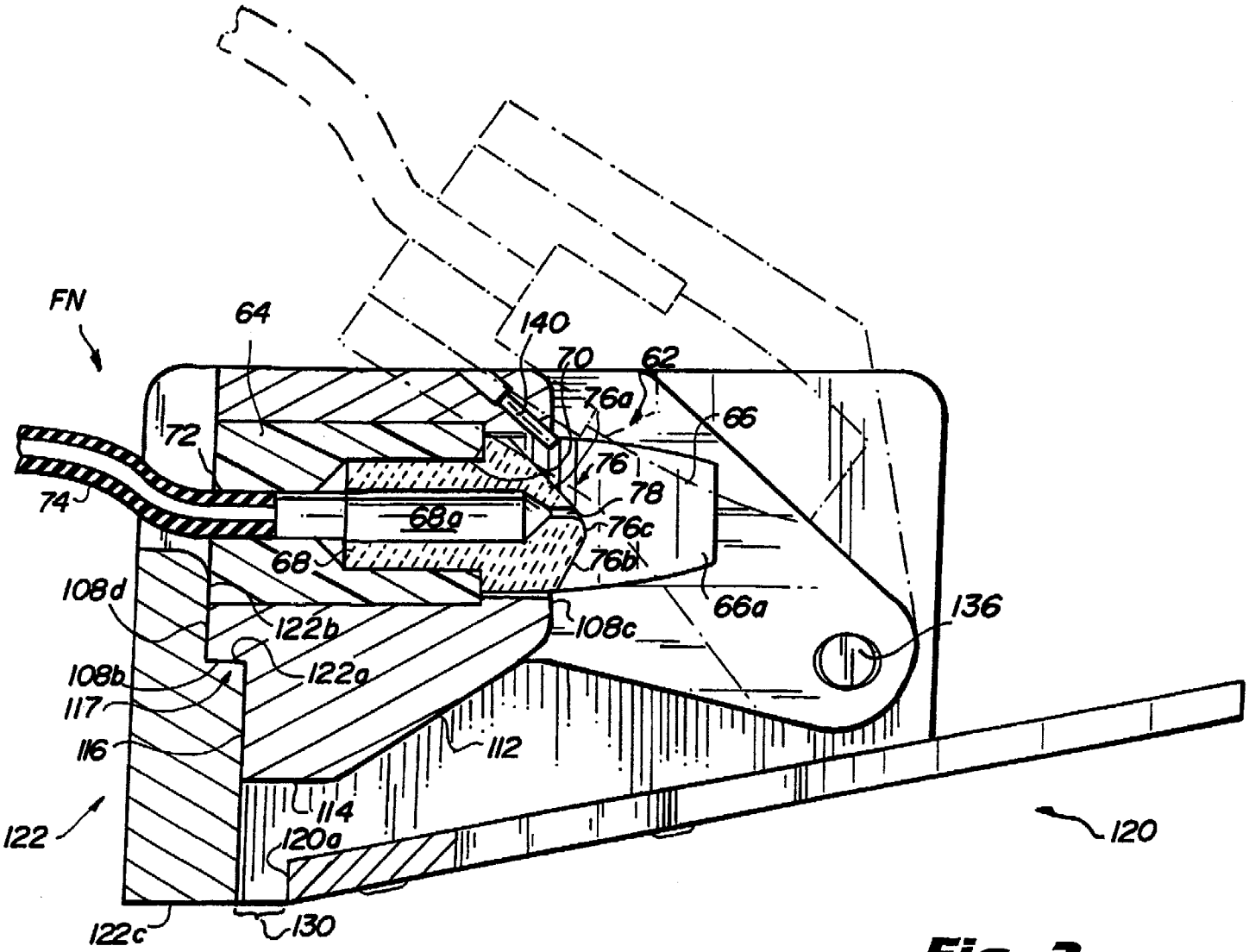
FIG. 2 is a cross-sectional view through line II—II in FIG. 4, including the finish applicator nozzle according to the invention.

As is perhaps most clearly shown in FIG. 2, a finish applicator nozzle FN according to this invention includes a ceramic applicator head 62 frictionally secured to an elastic connector 64. The ceramic applicator head 62 includes at a forward end a filament slot 66 oriented in a vertical plane coincident with the longitudinal axis of its respective threadline 14, which is defined between a laterally opposed pair of guide arms **66*a*, 66*b* (see FIG. 3). A reduced perimeter tubular connector section 68 rearwardly extends from the applicator head 62 and establishes an axially elongate supply chamber 68*a*. The connector section is sized so as to be inserted in friction fit relationship within a forward opening 70 defined in the elastic connector 64. The rearward opening 72 of the elastic connector fluid communicates with the forward opening 70 of the elastic connector 64 (and hence with the supply chamber 68*a* of the applicator head 62). The rearward opening 72 is itself sized so as to receive in friction fit relationship a finish supply line 74**, which is connected to a low pressure (e.g., slightly above atmospheric) source of finish oil (not shown).

The elastic connector is preferably formed of virtually any plastics material that is compatible with the finish oil, for example, nylon, ultra high molecular weight (UHMW) polyethylene or the like. Of course, other materials may be suitable for the elastic connector so long as they are sufficiently elastic to frictionally receive the reduced perimeter connector section 68 to thereby establish a low pressure, liquid tight seal. In similar respect, the material must be rigid enough to receive a finish supply line that is frictionally insertable into the rearward opening 72 of the elastic connector 64.

The filament slot 66 includes a V-shaped finish oil transfer surface 76 comprised of upper and lower transfer surfaces **76*a*, 76*b*, respectively, which diverge rearwardly film a smooth apex surface 76*c*. A finish oil supply orifice 78 establishes fluid communication between the supply chamber 68*a* and the transfer surface 76*a* so that finish oil supplied to the chamber 68*a* via the supply line 74 is caused to flow onto the transfer surface 76*a*. As will be observed, the discharge end of the orifice 78 is located above the apex surface 76*c*. Thus, finish oil supplied through the orifice 78 will flow by gravity along the transfer surface 76*a* to the apex surface 76*c* where at least a portion is transferred to the threadline in contact with the apex surface 76*c***.

The effective length of the transfer surface **76*a* is greater than the effective length of the transfer surface 76*b*. Thus, the filament slot 66 is "deeper" at its top end than at its lower end. That is, the transfer surface 76*a* terminates with the opposed guide arms 66*a*, 66*b* at a location that is farther from the apex surface 76*c* as compared to the location at which the surface 76*b* terminates with the guide arms 66*a*, 66*b*. Thus, although each of the surfaces 76*a*, 76*b* terminates at the apex surface 76*c*, the apex surface 76*c* is itself offset below the axial center line of the applicator head 62 so as to achieve the differences in effective length of the surfaces 76*a*, 76*b*. The same effect can be achieved, however, using transfer surfaces 76*a*, 76*b* of the same length, wherein each transfer surface extends toward the apex surface 76*c* at a different angle. Other variations on this effect can be achieved using both different effective lengths of the surfaces 76*a*, 76*b*** and different angles.

The finish applicator FA according to the invention is configured to support a plurality of the finish applicator nozzles FN. FIGS. 3–6 more clearly illustrate the finish applicator FA according to this invention. Specifically, as shown, the finish applicator FA includes a frame 102 and an apertured member 104.

The apertured member 104 includes two side members 106 fixed to opposite ends of a tubular bar 108. The side members 106 are secured to the ends of the tubular bar 108 by screws or the like. Each side member 106 has a top surface **106*a* disposed substantially parallel to a bottom surface 106*b*, and a rear surface 106*c* disposed substantially perpendicular to the top and bottom surfaces 106*a*, 106*b*. A stop surface 106*d* extends downwardly at an angle from a forward end of the top surface 106*a* to a rounded end 106*e* that transitions to a connecting surface 106*f*. The connecting surface 106*f* extends rearwardly and upwardly at an angle and terminates at the bottom surface 106*b***.

The tubular bar 108 is preferably square in cross section and therefore includes top and bottom surfaces **108*a*, 108*b*, respectively, and front and rear surfaces, 108*c*, 108*d*, respectively. A plurality of apertures 110 are formed through the front and rear surfaces 108*c*, 108*d*, each having a longitudinal axis that is substantially parallel with a plane defined by the top and bottom surfaces 108*a*, 108*b*** of the tubular bar 108. The plurality apertures 110 are shaped to receive a corresponding plurality of the finish applicator nozzles FN. In a preferred embodiment, the tubular bar 108 includes six apertures 110 for supporting six finish applicator nozzles FN, but more or fewer than six nozzles may be employed depending upon the number of threadlines that are present.

To ensure proper alignment and proper insertion of the nozzles FN, alignment pins 140 extend through the top surface 108*a* of the tubular bar 108 into each of the plurality of apertures 110. The alignment pins 140 are secured to the apertured member 104 in respective alignment pin holes 142 by any suitable securing means, such as by welding, adhesive bonding or a threaded connection. The alignment pins 140 are disposed at an angle in the respective apertures 110 substantially corresponding to the angle of the upper transfer surface 76*a*. The pins 140 therefore not only ensure proper insertion of the nozzles FN, but also ensure that the nozzles FN are properly oriented. That is, if a nozzle FN is inserted upside-down, the alignment pin 140 will contact the surface 76*b*, which prevents the nozzle FN from being fully seated in its respective aperture 110. As a result, the back surface of the elastic connector 64 will not be flush with the apertured member 104. On the other hand, since the filament slot 66 is "deeper" due to the greater effective length of the surface 76*a*, when the nozzle FN is properly oriented, the alignment pin 140 will contact the surface 76*a* and allow the rear surface of the elastic connector 64 to be substantially flush with the apertured member 104.

A transfer surface 112 (see FIG. 2) extends from the bottom end of the front surface 108*c* downwardly and rearwardly beneath the apertures and terminates at a plateau surface 114 that is substantially parallel with the top surface 108*a*. A cut-out surface 116 extends upwardly substantially perpendicular to the plateau surface 114 toward the bottom surface 108*b*, thereby defining a shoulder 117. The transfer surface 112 serves to guide excess finish oil toward a drain slot 130 (described below).

The frame 102 includes a pair of end members 118, a guide tab plate 120 and a locking bar 122. The end members 118 are secured to opposite ends of the guide tab plate 120 by screws or the like, and the locking bar 122 is preferably secured between the end members 118 by screws or the like. The end members 118 are substantially rectangular except for their bottom surface 118*a*, which is disposed at a downward angle from front to rear and terminates in a stepped portion 118*b* to accommodate the guide tab plate 120. That is, the guide tab plate 120 and bottom of the stepped portion 118*b* are substantially flush because the guide tab plate 120 is fitted in the stepped portion 118*b*.

Figure 3:
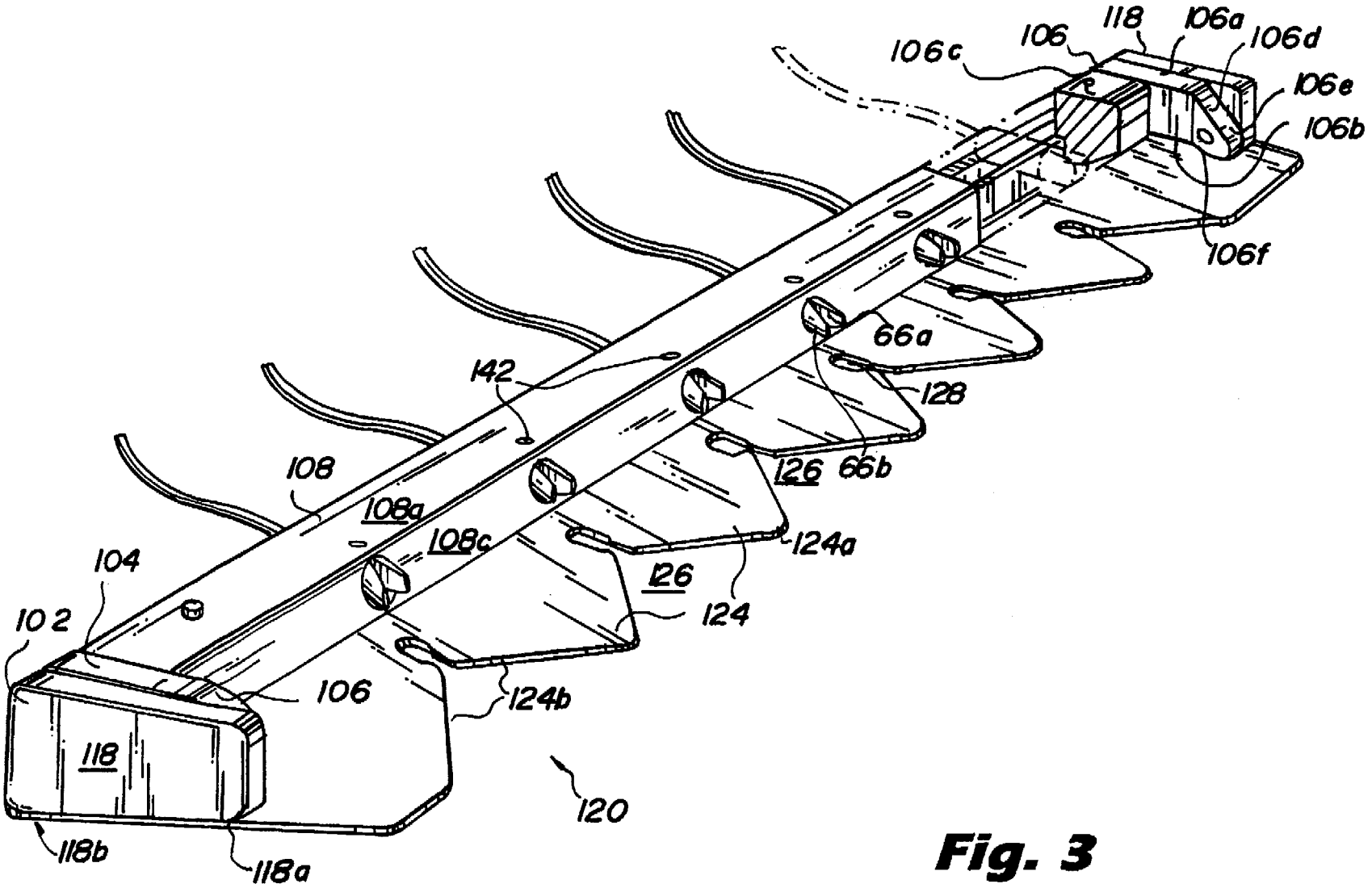
FIG. 3 is a perspective view of the finish applicator according to the invention.
Figure 4:
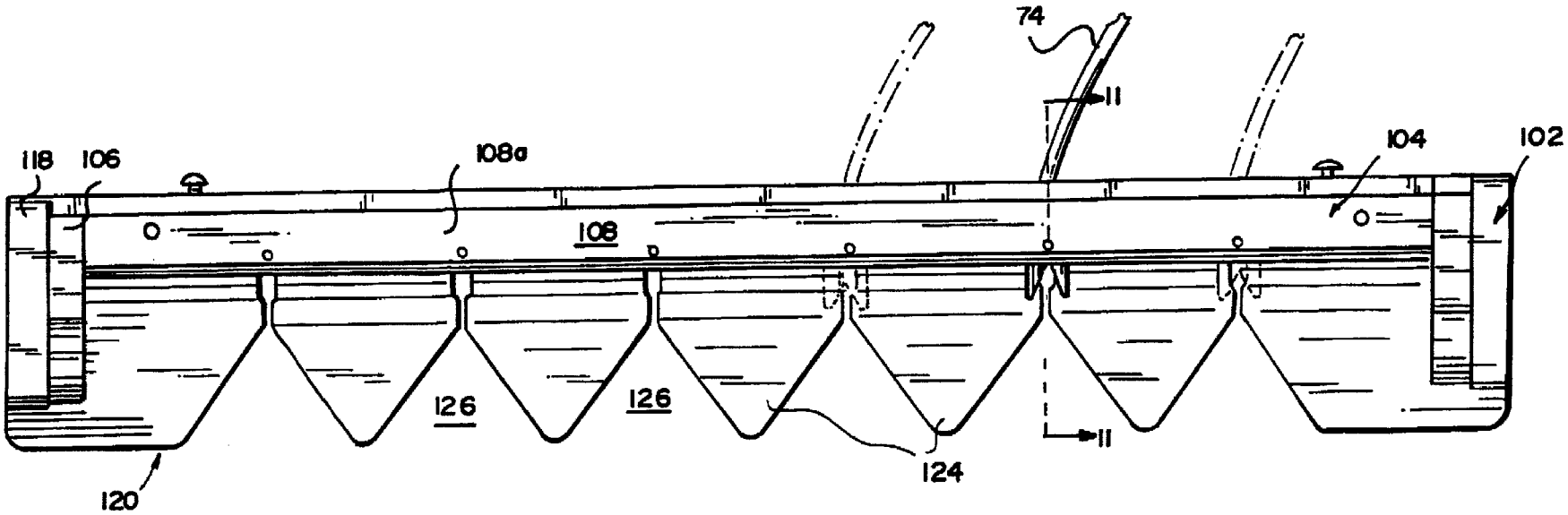
FIG. 4 is a plan view of the finish applicator according to the invention.

Referring to FIGS. 3 and 4, the guide tab plate 120 is substantially flat and forms a plurality of guide tabs 124. The guide tabs 124 are substantially arrowhead shaped with a rounded apex 124*a*. The sides of the arrowheads and the leftmost and rightmost portions of the guide tab plate include guide surfaces 124*b* that form the specific guides 126 for the filaments. The guide surfaces 124*b* terminate in respective filament wells 128 that are aligned with the longitudinal axes of the threadlines. The guide surfaces 124*b* serve to guide the threadlines 14 into a respective finish applicator nozzle FN. Because the guide tab plate 120 is fixed to the angled bottom surface 118*a* of the end members 118, the guide tab plate 120 and guide tabs 124 are therefore disposed at a downward angle from front to rear relative to the axial center line of the applicator head 62.

Figure 5:
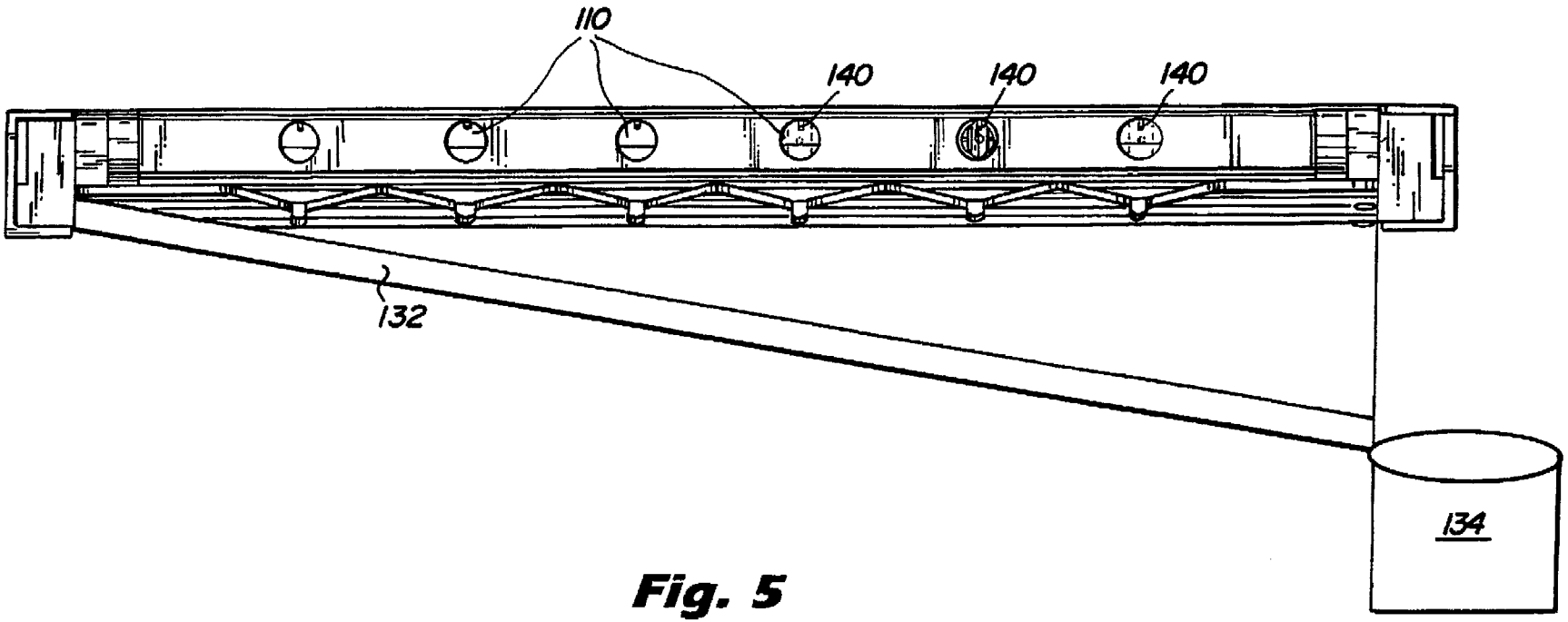
FIG. 5 is a front view of the applicator according to the invention.

As is most clearly shown in FIG. 2, the locking bar 122 extends vertically to about ¾ of the height of the end members 118. The locking bar 122 includes a ledge 122*a* and a locking surface 122*b*. The bottom surface 122*c* of the locking bar 122 is disposed spaced from the rear end 120*a* of the guide tab plate 120 such that a drain slot 130 is formed between them. In operation, excess finish oil that leaks from the nozzle FN will be guided by the downwardly and rearwardly sloping transfer surface 112 onto the guide tabs 124 and will be drawn by gravity toward the drain slot 130 disposed adjacent the guide tab plate 120 spaced from the locking bar 122. As shown in FIG. 5, a drain 132 is disposed beneath the drain slot 130 to catch the excess material exiting through the drain slot 130. The drain 132 is disposed at a downward angle such that any finish oil in the drain is urged by gravity toward a drain receptacle 134.

The side members 106 of the apertured member 104 are pivotally secured to the end members 118 of the frame 102 by a pin 136 or the like. The apertured member 104 is thus pivotable about the pin 136 between an insertion position (illustrated in phantom in FIG. 2) and an operation position (illustrated in solid line in FIG. 2). In the insertion position, the apertured member 104 is pivoted (clockwise in FIG. 2) until the stop surfaces 106*d* of the side members 106 rest against the guide tab plate 120. In this position, the apertures 110 are unobstructed, and the finish applicator nozzles FN are easily insertable into the apertures 110.

Figure 6:
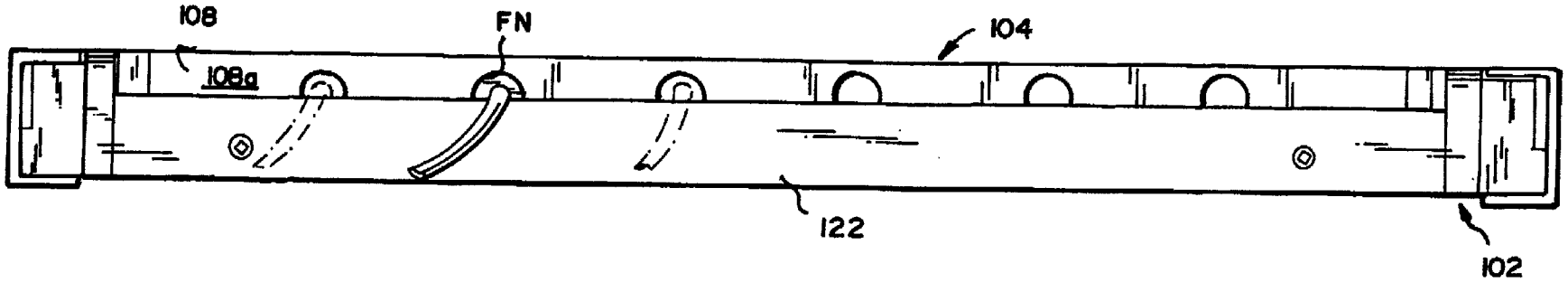
FIG. 6 is rear view of the applicator according to the invention.

After all of the nozzles have been properly inserted in their respective apertures, the apertured member can be pivoted (counter-clockwise in FIG. 2) until the bottom surface 108*b* of the tubular bar and the bottom surfaces 106*b* of the side members 106 engage the ledge 122*a* of the locking bar 122, wherein the apertured member 104 is in the operating position. As described above, if any of the nozzles FN are not properly inserted into their respective aperture 110, the back surface of the elastic connector 64 will not be flush with the apertured member 104, which thereby would prevent the apertured member 104 from pivoting to its operating position—i.e., since a portion of the elastic connector 64 extends out of the apertured member 104 and contacts the locking bar 122, preventing the apertured member 104 from being moved to its operating position. In the operating position, as illustrated in FIGS. 2 and 6, the locking portion 122*b* of the locking bar 122 obstructs a portion of the apertures 110, thereby locking the finish applicator nozzles FN in their respective apertures 110.

Figure 7:
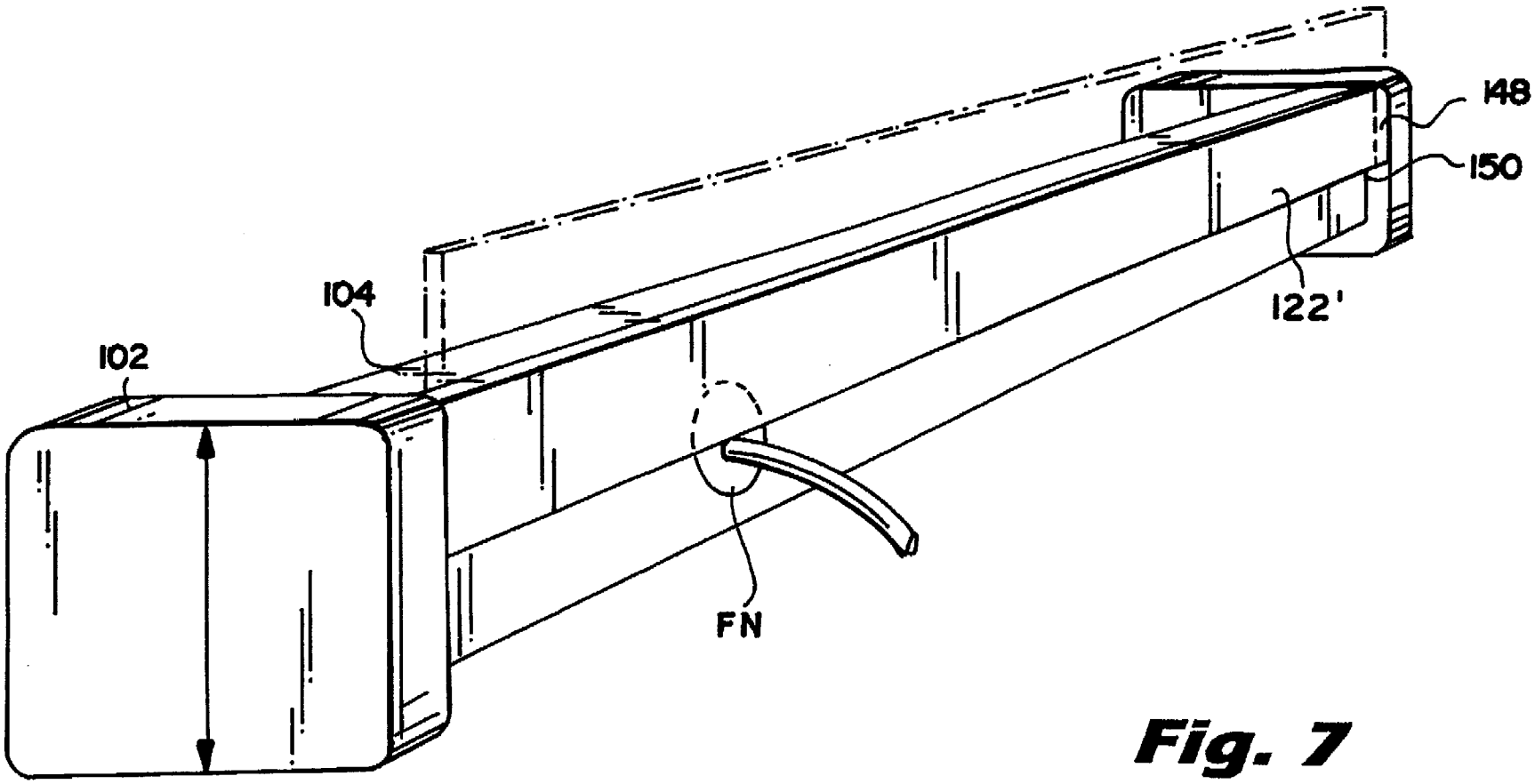
FIG. 7 illustrates an alternative embodiment of the mounting unit according to the invention.

In an alternative embodiment, illustrated in FIG. 7, the apertured member 104 is fixed with respect to the frame 102, and a modified bar 122' serving as the locking mechanism is movable between an operating position (illustrated in solid line in FIG. 7), where the finish applicator nozzles FN are locked in their respective apertures 110, and an insertion position (shown in phantom in FIG. 7), where the nozzles FN are easily removable or insertable into the apertured member 104. The movable bar 122' may take various forms. In an exemplary arrangement, the bar 122' is slidable in a track 148 formed on opposite sides of the frame 102. After the nozzles FN are inserted into their respective apertures 110, the bar 122' is, for example, downwardly slidable in the track 148 until it reaches an end 150 of the track serving as a stop. The bar 122' is then in the operating position and obstructs a portion of the apertures 110, thereby locking the finish applicator nozzles FN in their respective apertures 110.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A finish applicator nozzle comprising:

a ceramic applicator head having a filament slot at a forward end and a reduced perimeter connector section at a rearward end; and an elastic connector having at a connecting end a first opening shaped to frictionally receive said reduced perimeter connector section and at an input end a second opening shaped to frictionally receive a finish supply line.

2. A finish applicator nozzle according to claim 1, wherein said filament slot comprises a substantially V-shaped oil transfer surface including an upper transfer surface, a lower transfer surface and an apex surface, said upper and lower transfer surfaces diverging rearwardly from said apex surface.

3. A finish applicator nozzle according to claim 2, wherein one of said upper transfer surface and said lower transfer surface is longer than the other of said upper transfer surface and said lower transfer surface.

4. A finish applicator nozzle according to claim 3, wherein said upper transfer surface is longer than said lower transfer surface.

5. A finish applicator nozzle according to claim 2, wherein each of said upper transfer surface and said lower transfer surface extends at different angles relative to an axial center line of said applicator head.

6. A finish applicator nozzle according to claim 2, wherein said apex surface is disposed offset from a center of said nozzle.

7. A finish applicator nozzle according to claim 1, wherein said elastic connector is formed of plastic.

8. A finish applicator nozzle according to claim 1, wherein said elastic connector is formed of nylon.

9. A finish applicator nozzle according to claim 1, wherein said elastic connector is formed of ultra high molecular weight (UHMW) polyethylene.

10. A finish applicator nozzle according to claim 1, wherein said elastic connector frictionally receives said reduced perimeter connector section providing a low pressure, liquid tight seal.

11. A finish applicator mounting unit comprising:

an apertured member having a plurality of apertures shaped to receive a corresponding plurality of finish applicator nozzles; and a locking mechanism that selectively obstructs the plurality of apertures such that when the corresponding plurality of finish applicator nozzles are received in said plurality of apertures, the finish applicator nozzles are selectively locked in the finish applicator mounting unit.

12. A finish applicator mounting unit according to claim 11, further comprising alignment means for ensuring proper alignment and insertion of the finish applicator nozzles.

13. A finish applicator mounting unit according to claim 12, wherein said alignment means comprises an alignment pin extending into each of said plurality of apertures.

14. A finish applicator mounting unit according to claim 11, further comprising a frame supporting said apertured member and said locking mechanism, said locking mechanism comprising a locking bar secured to said frame, wherein said apertured member is pivotally secured to said frame to pivot between an operating position, in which said locking bar obstructs said plurality of apertures, and an insertion position, in which said plurality of apertures are unobstructed by said locking bar.

15. A finish applicator mounting unit according to claim 11, further comprising a frame supporting said apertured member and said locking mechanism, said locking mechanism comprising a movable bar secured to said frame for movement between an operating position, in which said movable bar obstructs said plurality of apertures, and an insertion position, in which said plurality of apertures are unobstructed by said movable bar.

16. A finish applicator mounting unit according to claim 12, further comprising a frame supporting said apertured member and said locking mechanism, said frame comprising a plurality of guide tabs forming a plurality of guide grooves corresponding to said plurality of apertures.

17. A finish applicator mounting unit according to claim 16, wherein said guide tabs are disposed at an angle relative to an axial center line of said apertures.

18. A finish applicator mounting unit according to claim 17, further comprising a drain slot disposed adjacent said guide tabs.

19. A finish applicator assembly comprising:

a plurality of finish applicator nozzles each including:

a ceramic applicator head having a filament slot at a forward end and a reduced perimeter connector section at a rearward end, and an elastic connector having at a connecting end a first opening shaped to frictionally receive said reduced perimeter connector section and at an input end a second opening shaped to frictionally receive a finish supply line; and a finish applicator mounting unit including:

an apertured member having a plurality of apertures shaped to receive the plurality of finish applicator nozzles, and a locking mechanism that selectively obstructs the plurality of apertures such that when the plurality of finish applicator nozzles are received in said plurality of apertures, the finish applicator nozzles are selectively locked in the finish applicator mounting unit.

20. A finish applicator assembly according to claim 19, wherein said finish applicator mounting unit further comprises:

a frame supporting said apertured member and said locking mechanism, said frame comprising a plurality of guide tabs forming a plurality of guide grooves corresponding to said plurality of apertures, said guide tabs being disposed at an angle relative to an axial center line of said apertures; and a drain slot disposed adjacent said guide tabs.

21. A finish applicator assembly according to claim 20, further comprising a drain disposed beneath said drain slot and a drain receptacle disposed at an end of said drain, said drain being disposed at a downward angle such that any finish oil in the drain is urged by gravity toward the drain receptacle.

22. A finish applicator assembly for applying a finish oil to a threadline, the finish applicator assembly comprising:

a plurality of finish applicator nozzles; and a finish applicator mounting unit including:

an apertured member having a plurality of apertures shaped to receive the plurality of finish applicator nozzles, and alignment means for aligning said plurality of finish applicator nozzles in said plurality of apertures;

wherein each of said plurality of finish applicator nozzles includes a filament slot defining a plane substantially parallel with the threadline and extending through opposed sides of the nozzle, and wherein said alignment means cooperates with said filament slot for aligning said plurality of finish applicator nozzles in said plurality of apertures.

23. A finish applicator assembly according to claim 22, wherein said filament slot comprises a substantially V-shaped oil transfer surface including an upper transfer surface, a lower transfer surface and an apex surface, said upper and lower transfer surfaces diverging rearwardly from said apex surface.

24. A finish applicator assembly according to claim 23, wherein one of said upper transfer surface and said lower transfer surface is longer than the other of said upper transfer surface and said lower transfer surface.

25. A finish applicator assembly according to claim 24, wherein said upper transfer surface is longer than said lower transfer surface.

26. A finish applicator assembly according to claim 25, wherein said alignment means comprises an alignment pin extending into each of said plurality of apertures, and wherein said nozzles are received in said apertures such that said alignment pins engage said upper transfer surfaces, respectively.

27. A finish applicator assembly according to claim 23, wherein said apex surface is disposed offset from a center of said nozzle.

* * * * *

UNITED STATES PATENT AND TRADEMARK OFFICE

CERTIFICATE OF CORRECTION

PATENT NO. : 5,679,158

DATED : October 21, 1997

INVENTOR(S) : Carl R. Holzer, Jr.; Walter L. Shaw; Bobby L. Tinsley; Gary Hanwell It is certified that error appears in the above-indentified patent and that said Letters Patent is hereby corrected as shown below:

In the Abstract at line 12, please delete "fictionally" after "head" and replace it with "frictionally".

Signed and Sealed this

Third Day of February, 1998

*Attest:*

Bruce Lehman

BRUCE LEHMAN

*Attesting Officer*

*Commissioner of Patents and Trademarks*